US008845417B1

(12) United States Patent
Englman et al.

(10) Patent No.: US 8,845,417 B1
(45) Date of Patent: Sep. 30, 2014

(54) BAD BEAT COMPENSATION FOR WAGERING GAMES

(75) Inventors: Allon G. Englman, Chicago, IL (US); Andrew C. Guinn, Chicago, IL (US); Travis N. Nelson, Canton, GA (US); James Palermo, Chicago, IL (US); Richard B. Robbins, Glenview, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/468,004

(22) Filed: May 9, 2012

Related U.S. Application Data

(60) Provisional application No. 61/484,088, filed on May 9, 2011.

(51) Int. Cl.
*A63F 1/00* (2006.01)

(52) U.S. Cl.
USPC ..... 463/25; 463/16; 463/17; 463/18; 463/19; 463/20; 463/40; 463/41; 463/42

(58) Field of Classification Search
USPC ..... 463/16–20, 25, 40–42
See application file for complete search history.

(56) References Cited

U.S. PATENT DOCUMENTS

| | | | | |
|---|---|---|---|---|
| 4,669,731 | A * | 6/1987 | Clarke | 463/20 |
| 5,178,390 | A * | 1/1993 | Okada | 273/143 R |
| 5,695,402 | A * | 12/1997 | Stupak | 463/20 |
| 6,270,409 | B1 * | 8/2001 | Shuster | 463/20 |
| 7,771,275 | B2 * | 8/2010 | Walker et al. | 463/25 |
| 7,887,410 | B2 * | 2/2011 | Okada | 463/20 |
| 2005/0261047 | A1 * | 11/2005 | Fiden et al. | 463/16 |
| 2006/0108736 | A1 * | 5/2006 | Walker et al. | 273/274 |
| 2007/0001397 | A1 * | 1/2007 | Walker et al. | 273/292 |
| 2007/0060254 | A1 * | 3/2007 | Muir | 463/16 |
| 2008/0248867 | A1 * | 10/2008 | Englman et al. | 463/25 |
| 2008/0254869 | A1 * | 10/2008 | Fujimoto et al. | 463/27 |
| 2008/0254871 | A1 * | 10/2008 | Fujimoto et al. | 463/27 |
| 2009/0275399 | A1 * | 11/2009 | Kelly et al. | 463/27 |
| 2010/0029381 | A1 * | 2/2010 | Vancura | 463/30 |
| 2011/0230252 | A1 * | 9/2011 | Davis et al. | 463/22 |

* cited by examiner

*Primary Examiner* — Justin Myhr
(74) *Attorney, Agent, or Firm* — DeLizio Gilliam, PLLC

(57) ABSTRACT

Systems and methods for determining bad beats in wagering games are disclosed. If the bad beat is determined to be compensable, some form of compensation is provided to the player. The compensation can include providing a free entry into a second wagering game. The second wagering game can be a site-wide wagering game in which a plurality of player may be simultaneously participating.

27 Claims, 8 Drawing Sheets

BAD BEAT COMPENSATION FOR WAGERING GAMES

RELATED APPLICATIONS

This application claims the priority benefit of U.S. Provisional Application Ser. No. 61/484,088 filed May 9, 2011.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

FIELD

Embodiments of the inventive subject matter relate generally to wagering game systems, and more particularly to wagering game systems providing compensation upon determining a bad beat.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play and retain players.

SUMMARY

Embodiments of the inventive subject matter determine bad beats in a wagering game. Examples of bad beats include a number of consecutive plays without a win and near miss events. The determination of a bad beat event can be based on a statistical model developed for the wagering game. If the bad beat is determined to be compensable, some form of compensation may be provided to the player. The compensation can include providing a free entry into a second wagering game. The second wagering game can be a site-wide wagering game in which a plurality of players may be simultaneously participating.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example wagering game machine architectures. The third section describes example operations performed by some embodiments and the fourth section describes example wagering game machines in more detail. The fifth section presents some general comments.

Introduction

This section provides an introduction to some embodiments of the invention. In general, the embodiments of the invention include wagering games in which bad beats are detected. If the bad beat is compensable, then the embodiments of the invention provide some form of compensation to the player. The compensation can take many forms as will be discussed in detail below. Generally speaking, a bad beat occurs when a player's win events or amounts are less than expected, or if the player experiences a near miss. For example, if a slot machine player goes ten spins without a single win, then the player has experienced a bad beat. As another example, a near miss may occur if a slot machine outcome is one symbol away from a large payout (e.g., if one of the reels is within one position of a payline, where the addition of the symbol to the payline would have resulted in a large payout). Many other examples of bad beats exist as will be described below. Bad beats can cause a player to become discouraged and to stop playing the wagering game or leave a casino. This can have the undesirable result of reducing revenue for the casino.

Operating Environment

This section describes an example operating environment and presents structural aspects of some embodiments. This section includes discussion about wagering game machine architectures, wagering game software architectures, and wagering game networks.

Wagering Game Machine Architectures

Figure 1:
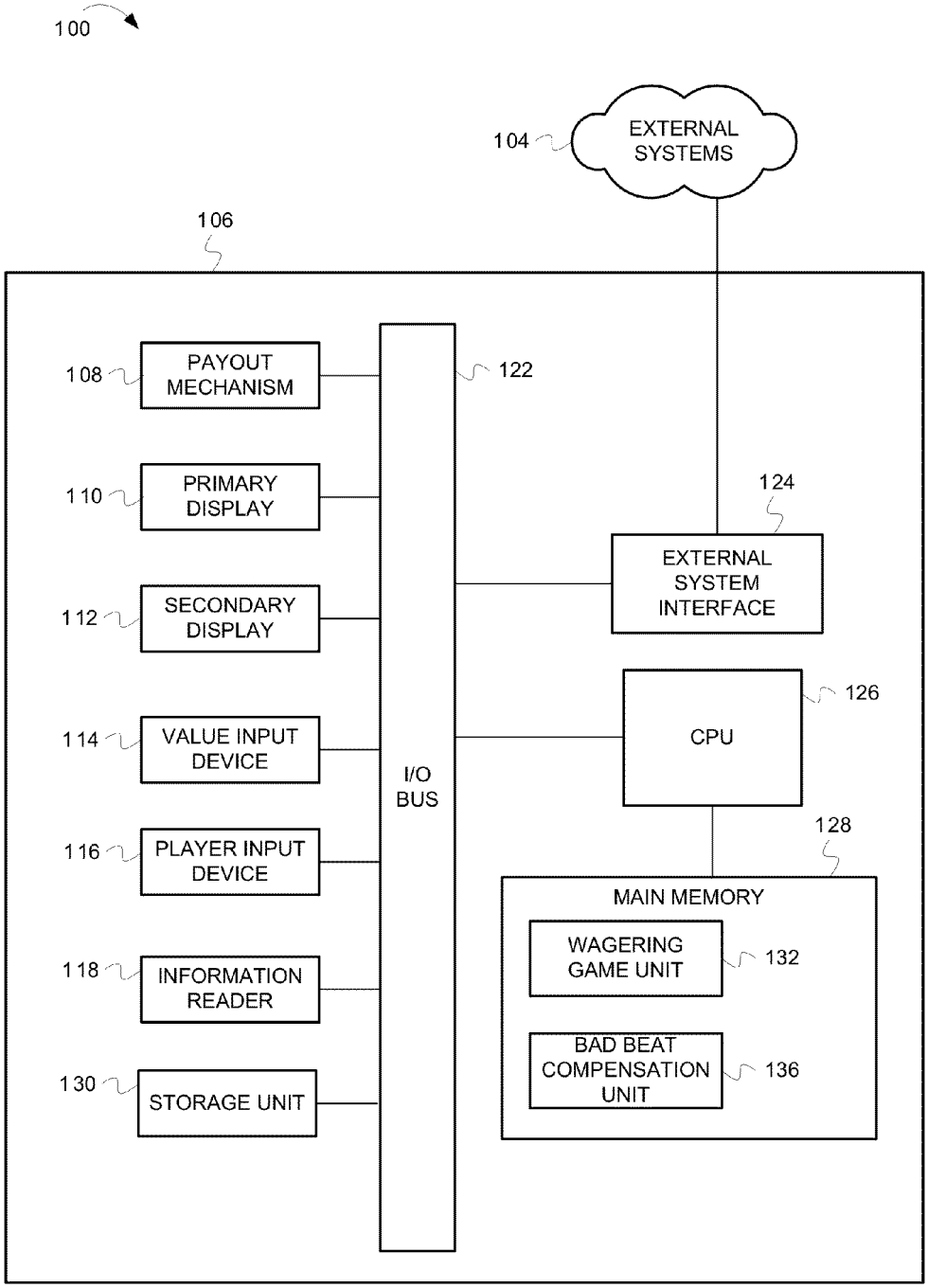
FIG. 1 is a block diagram illustrating a wagering game machine architecture according to example embodiments of the invention.

FIG. 1 is a block diagram illustrating a wagering game machine architecture 100, according to example embodiments of the invention. As shown in FIG. 1, the wagering game machine architecture 100 includes a wagering game machine 106, which includes a central processing unit (CPU) 126 connected to main memory 128. The CPU 126 can include any suitable processor, such as an Intel® Pentium processor, Intel® Core 2 Duo processor, AMD Opteron™ processor, or UltraSPARC processor. The main memory 128 includes a wagering game unit 132. In one embodiment, the wagering game unit 132 can present wagering games, such as video poker, video black jack, video slots, video lottery, etc., in whole or part. In some embodiments, main memory 128 may include a bad beat compensation unit 136. Bad beat compensation unit 136 can detect bad beats, determine if compensation is to be provided for the bad beat, and if so, determine the compensation and arrange for the compensation to be provided. Further details on the operation of bad beat compensation unit 136 are provided below.

The CPU 126 is also connected to an input/output (I/O) bus 122, which can include any suitable bus technologies, such as an AGTL+frontside bus and a PCI backside bus. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include multiple external system interfaces 124 and/or multiple CPUs 126. In one embodiment, any of the components can be integrated or subdivided.

Any component of the architecture 100 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 1 describes an example wagering game machine architecture generally used in a casino environment, this section continues with a discussion of an online wagering game environment used in some embodiments.

Figure 2:
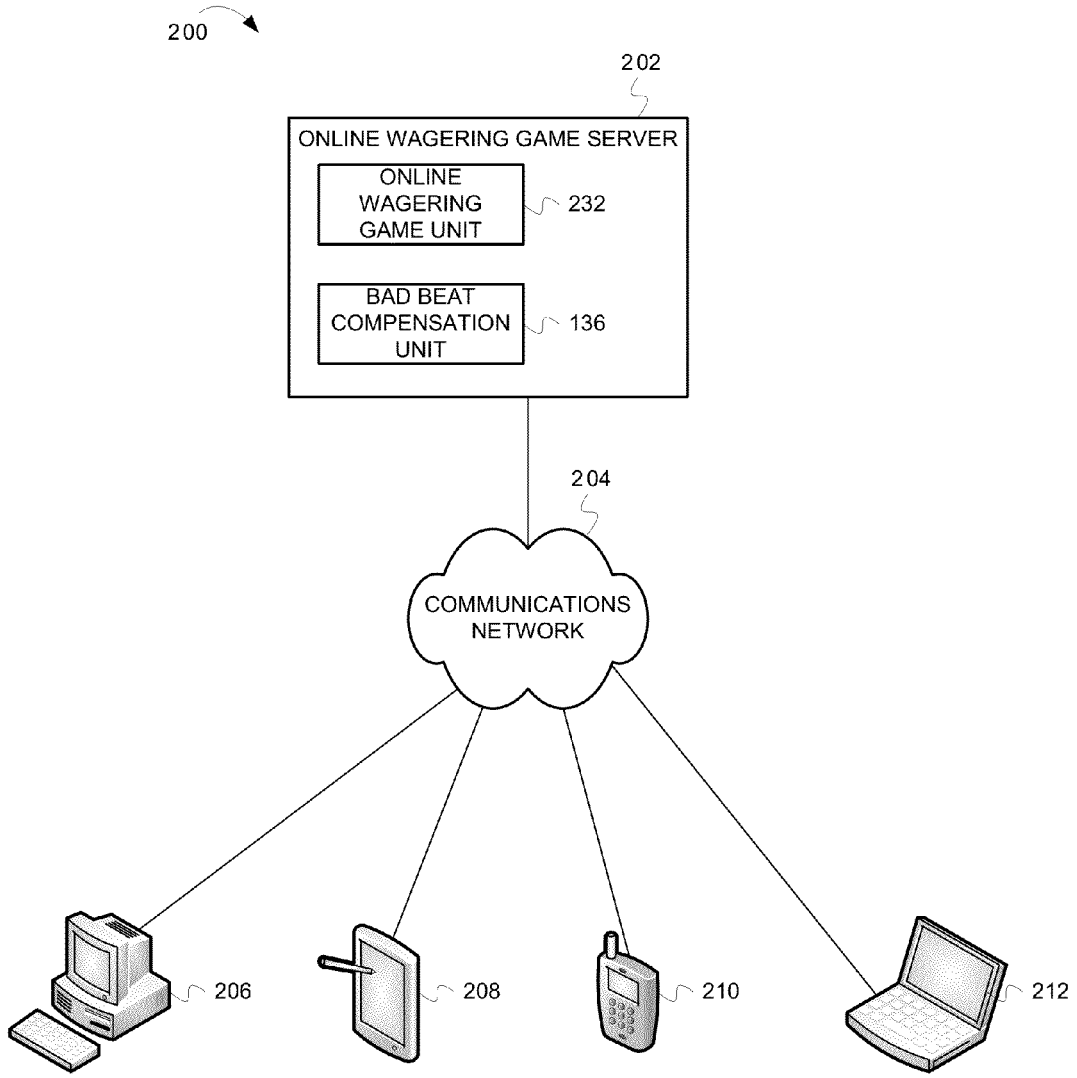
FIG. 2 is a block diagram illustrating an online wagering game system architecture according to example embodiments of the invention.

FIG. 2 is a block diagram illustrating an online wagering game system architecture according to example embodiments of the invention. In some embodiments, system 200 includes an online wagering game server 202 that is communicably coupled with one or more network entities through network 204. In general, network 204 may be any type of network or collection of networks such as the Internet. Online wagering game server 202 presents wagering games via online wagering game unit 232 to a network entity such as personal computer 206, tablet computer 208, mobile phone 210 or laptop computer 212. Like wagering game unit 132, online wagering game unit 232 can present wagering games, such as video poker, video black jack, video slots, video lottery, etc., in whole or part. Although illustrated as within wagering game server 202, functionality for the online wagering game 232 may be distributed among other wagering game servers and among the network entities. Similar to system 100, online wagering game server 200 includes a bad beat compensation unit 136.

Figure 3:
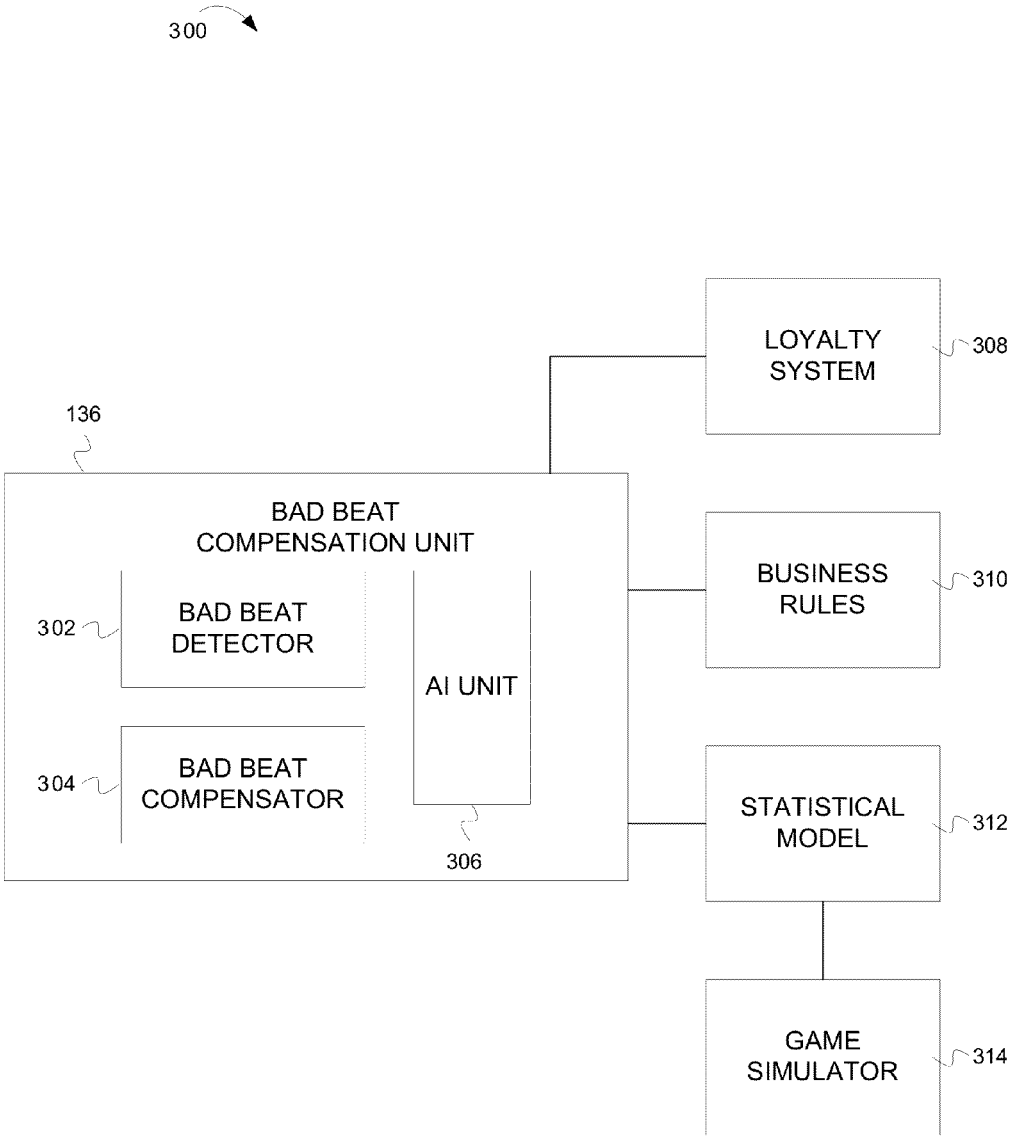
FIG. 3 is a block diagram illustrating major logical components of a software architecture in which embodiments of the invention may be practiced.

FIG. 3 is a block diagram illustrating major logical components of a software architecture 300 in which embodiments of the invention may be practiced. In some embodiments, software architecture 300 includes bad beat compensation unit 136 and may optionally include one or more of loyalty system 308, business rules 310, statistical model 312 or game simulator 314. As noted above, bad beat compensation unit 136 can detect bad beats, determine if compensation is to be provided for the bad beat, and if so, determine the compensation and arrange for the compensation to be provided. In some embodiments, bad beat compensation unit 136 may include subunits such as bad beat detector 302 and bad beat compensator 304.

Bad beat detector 302 analyzes wagering game outcomes on a wagering game and determines if a bad beat event has occurred. In some embodiments, the algorithms or heuristics used to determine that a bad beat has occurred may be implemented totally within bad beat detector 302. In alternative embodiments, bad beat detector 302 may use business rules 310 in addition to, or instead of, algorithms in bad beat detector 302. Business rules 310 may define the conditions that are present in order for a bad beat to occur. Business rules 310 may be editable such that a casino operator can change the rules that define a bad beat.

Bad beat detector 302 may use data maintained by loyalty system 308 in order to determine the occurrence of a bad beat. Loyalty system 308 maintains information about a wagering game player and may award loyalty points for various activities based on a player's wagering game play history. Loyalty system 308 may also be referred to as a player tracking system.

Bad beat detector 302 may use a statistical model 312 to determine if a bad beat event has occurred. Statistical model 312 may include statistics with respect to each of the possible outcomes for a wagering game. Statistical model 312 can be used by bad beat detector 302 to aid in determining if a player's wagering game play outcomes are outside of statistical norms for a wagering game. Statistical model 312 may be developed using actual wagering game results. Alternatively, statistical model 312 may be developed using a game simulator 314 that repeatedly simulates play of a wagering game.

Bad beat compensator 304 determines compensation, if any, that will be provided as a result of the bad beat event. Like bad beat detector 302, bad beat compensator 304 may use business rules 310 to determine the level of compensation to be provided, if any, upon the occurrence of a bad beat event. Further, bad beat compensator 304 may use input from loyalty system 308 or statistical model 312 in order to determine the level of compensation for a bad beat event.

In some embodiments, an AI (Artificial Intelligence) unit 306 may be used to determine if a bad beat event has occurred. AI unit 306 may use business rules 310 along with other heuristics to determine if a bad beat event has occurred, or to determine the compensation to be provided upon the occurrence of the bad beat.

Although illustrated in FIG. 1 as residing in the main memory of a wagering game machine, bad beat compensation unit 136 may operate on other machines such as a central gaming controller or a server communicably coupled to the wagering game machine via a network. Further, bad beat detector 302 and bad beat compensator 304 may be integrated with bad beat compensation unit 136, or may be separate units that may operate on one or more wagering game machines, central gaming controllers or servers.

Further details on the operations of various embodiments of a bad beat compensation unit 136 are provided below with respect to FIGS. 5-7

Wagering Game Networks

Figure 4:
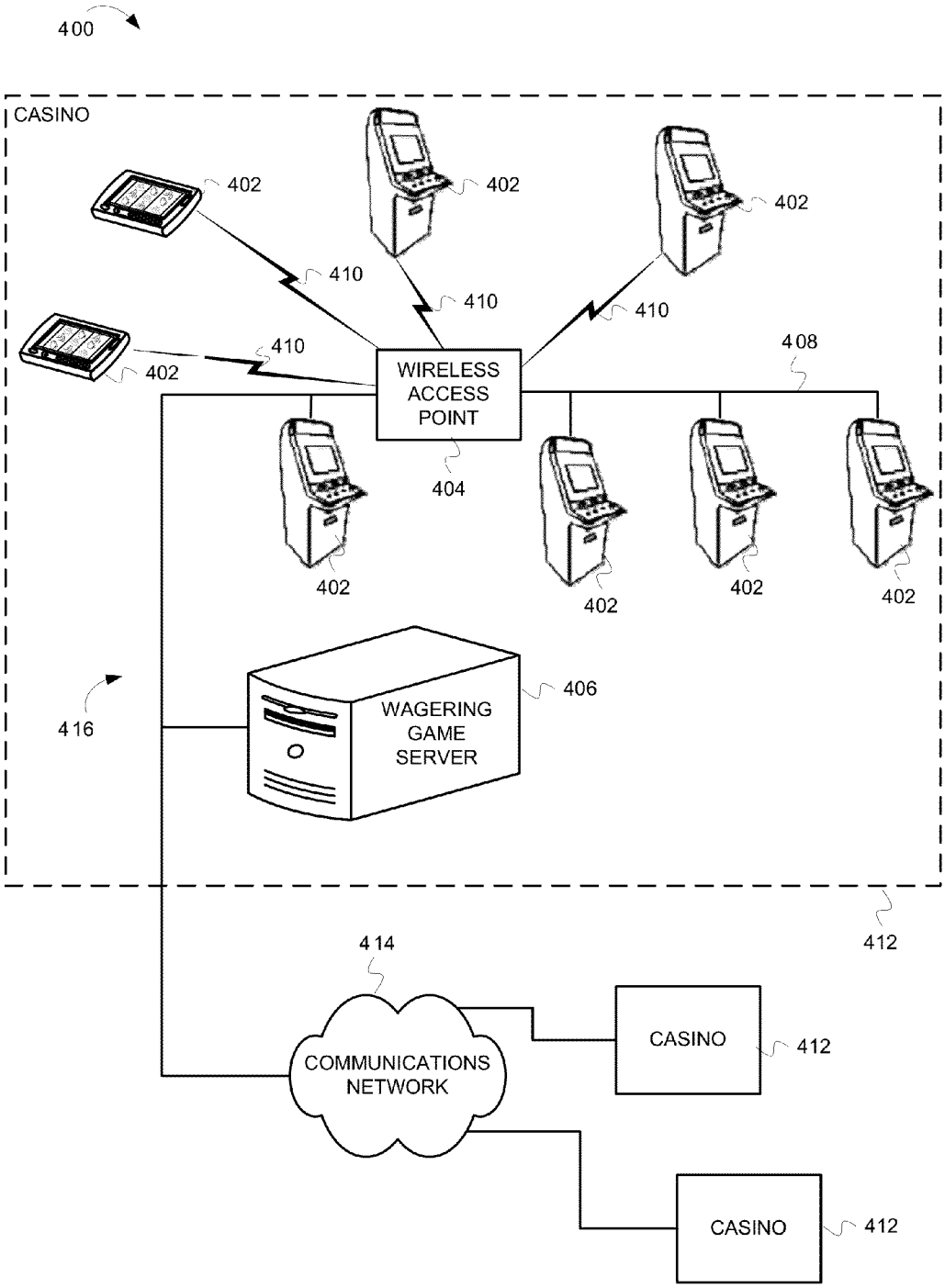
FIG. 4 is a block diagram illustrating a wagering game network, according to example embodiments of the invention.

FIG. 4 is a block diagram illustrating a wagering game network 400, according to example embodiments of the invention. As shown in FIG. 4, the wagering game network 400 includes a plurality of casinos 412 connected to a communications network 414.

Each casino 412 includes a local area network 416, which includes an access point 404, a wagering game server 406, and wagering game machines 402. The access point 404 provides wireless communication links 410 and wired communication links 408. The wired and wireless communication links can employ any suitable connection technology, such as Bluetooth, 802.11, Ethernet, public switched telephone networks, SONET, etc. In some embodiments, the wagering game server 406 can serve wagering games and distribute content to devices located in other casinos 412 or at other locations on the communications network 414.

The wagering game machines 402 described herein can take any suitable form, such as floor standing models, handheld mobile units, bartop models, workstation-type console models, etc. Further, the wagering game machines 402 can be primarily dedicated for use in conducting wagering games, or can include non-dedicated devices, such as mobile phones, personal digital assistants, personal computers, etc. In one embodiment, the wagering game network 400 can include other network devices, such as accounting servers, wide area progressive servers, player tracking servers, and/or other devices suitable for use in connection with embodiments of the invention.

In some embodiments, wagering game machines 402 and wagering game servers 406 work together such that a wagering game machine 402 can be operated as a thin, thick, or intermediate client. For example, one or more elements of game play may be controlled by the wagering game machine 402 (client) or the wagering game server 406 (server). Further, some or all of a bad beat compensation unit 136 may be implemented within a wagering game server 406. Game play elements can include executable game code, lookup tables, configuration files, game outcome, audio or visual representations of the game, game assets or the like. In a thin-client example, the wagering game server 406 can perform functions such as determining game outcome or managing assets, while the wagering game machine 402 can present a graphical representation of such outcome or asset modification to the user (e.g., player). In a thick-client example, the wagering game machines 402 can determine game outcomes and communicate the outcomes to the wagering game server 406 for recording or managing a player's account.

In some embodiments, either the wagering game machines 402 (client) or the wagering game server 406 can provide functionality that is not directly related to game play. For example, account transactions and account rules may be managed centrally (e.g., by the wagering game server 406) or locally (e.g., by the wagering game machine 402). Other functionality not directly related to game play may include power management, presentation of advertising, software or firmware updates, system quality or security checks, etc.

Any of the wagering game network components (e.g., the wagering game machines 402) can include hardware and machine-readable media including instructions for performing the operations described herein.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 5:
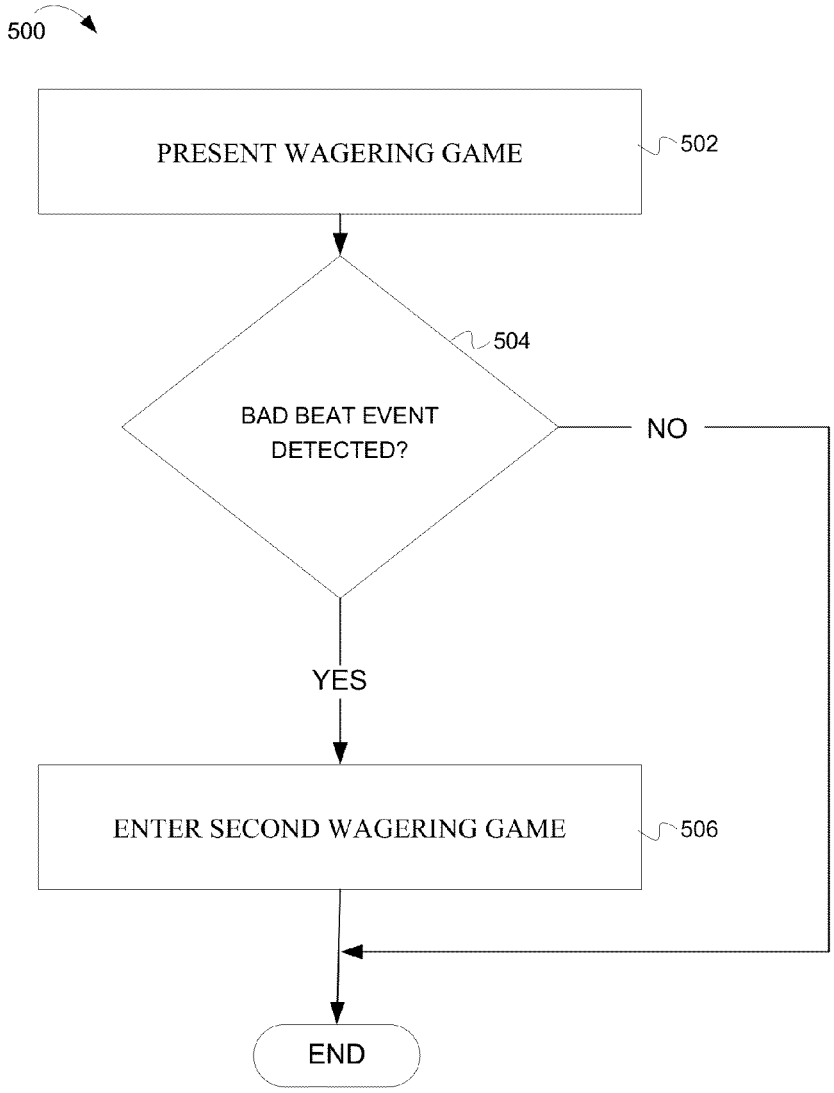
FIG. 5 is a flowchart illustrating a method for compensating a player upon the occurrence of a bad beat event.
Figure 6:
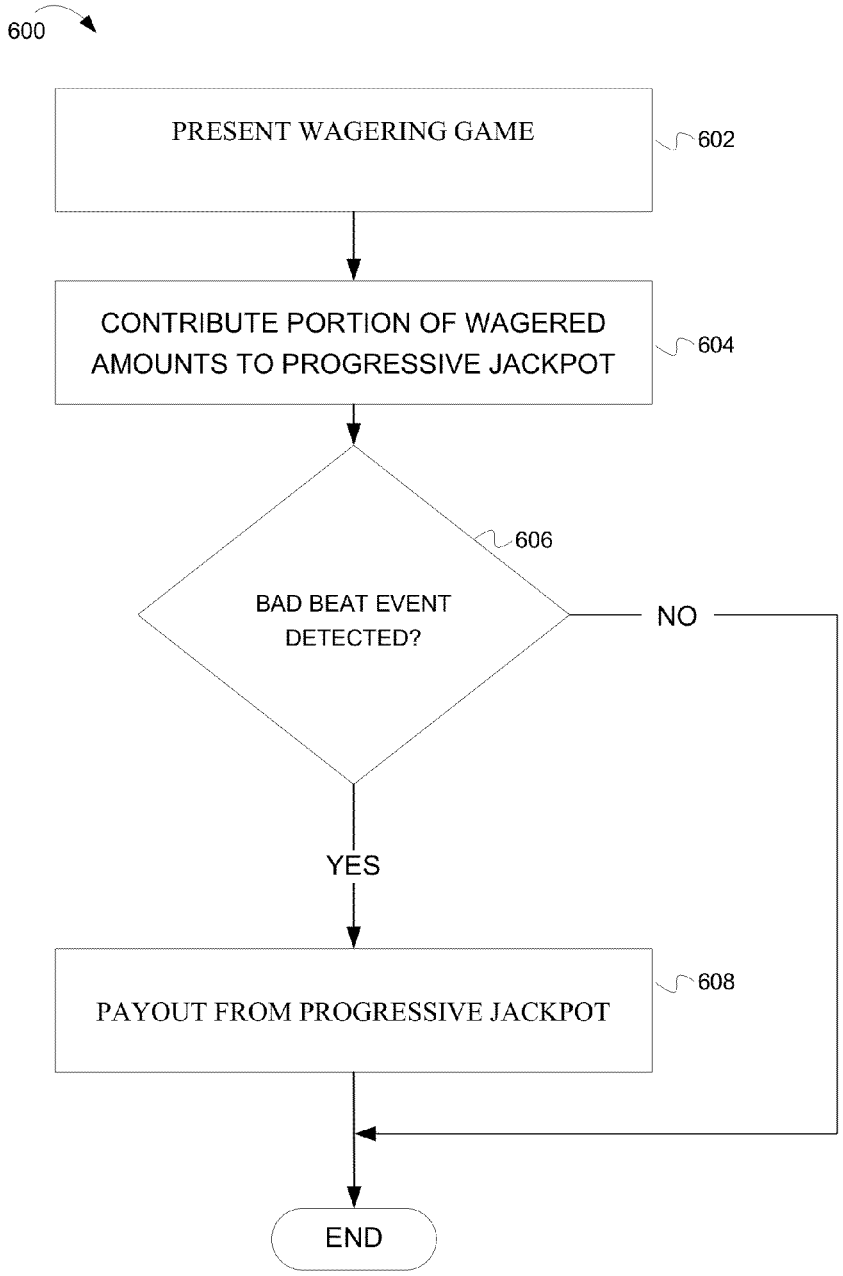
FIG. 6 is a flowchart illustrating a method for compensating a player upon the occurrence of a bad beat event in accordance with alternative embodiments.
Figure 7:
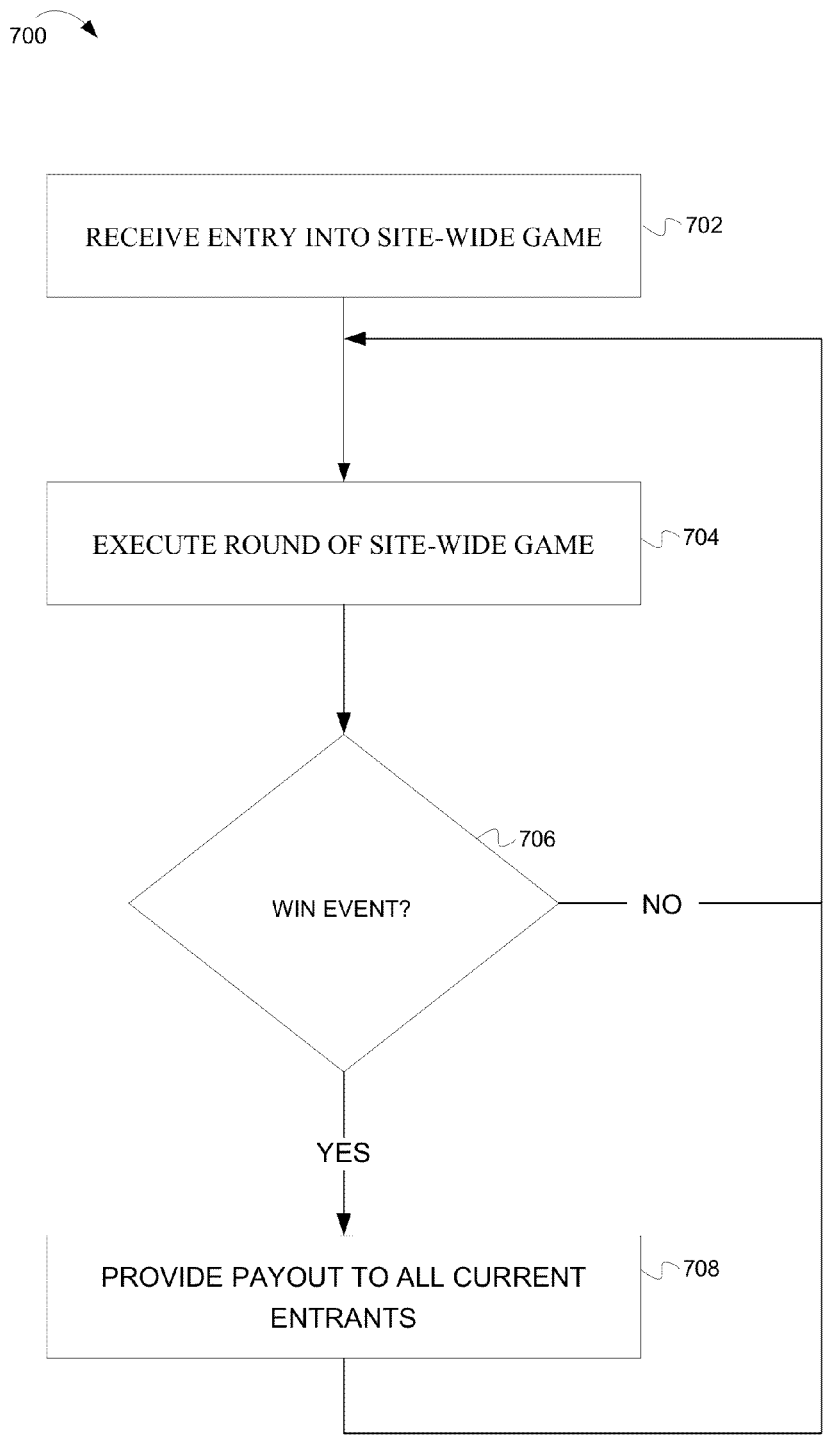
FIG. 7 is a flowchart illustrating a method of operating a multi-player wagering game.

The section will discuss FIGS. 5-7. The discussion of FIGS. 5-6 will describe operations for determining the occurrence of a bad beat event and for providing compensation for the bad beat event. The discussion of FIG. 7 will describe operations for a wagering game that may be provided as compensation for a bad beat event.

FIG. 5 is a flowchart illustrating a method 500 for compensating a player upon the occurrence of a bad beat event. The method begins at block 502 with the presentation of a wagering game. The wagering game may be any type of wagering game including mechanical or video slots or other video casino games, such as blackjack, keno, poker, blackjack, roulette, bingo, etc.

At block 504, a check is made to determine if a bad beat event has occurred. Various types of bad beats may be detected, with some types of bad beats applying to particular types of wagering games and not others. Bad beat events may be categorized as failure to win events and near miss events. A failure to win bad beat event occurs when a wagering game does not produce a winning outcome over a number of plays or where the player loses substantially more money than would ordinarily be expected. For example, in the case of a slots game, a bad beat event may occur if a player does not have a winning outcome after ten spins. Similarly, if a player at a video poker machine does not have a winning hand after ten consecutive plays, the system may determine that a bad beat event has occurred.

It should be noted that the number of plays without a winning outcome may be different for different wagering games or different configurations of the same wagering game. For instance, for a given payout percentage, wagering games can be configured to produce a high hit frequency (many wins with low average payout) or low hit frequency (few wins with high average payouts). Thus the number of plays without a win required in order for a bad beat to be determined may be higher for a machine with a low hit frequency where the expectation is that it may take many spins to get a payout. Statistical model 312 may be used to determine an appropriate number of consecutive winless plays required in order for a bad beat to be determined.

The number of winless plays required for a bad beat may be consecutive winless plays. For example, in the case of a slot machine, ten consecutive winless plays may be required in order for a bad beat to be determined. However, not all embodiments utilize consecutive plays in determining a bad beat. For example, a bingo style game may determine a bad beat if a player is simultaneously playing ten cards and none of the bingo cards produces a win. Similarly, a player may be simultaneously playing ten hands of a card game. A bad beat may be determined if none of the hands results in a win.

In some embodiments, a bad beat may be determined upon losing an amount of money over a configurable or predetermined amount of time or plays, where the loss is significantly above what would be expected for the wagering game. Similarly, a bad beat may be determined if the net payback percentage achieved during a session is significantly below the expected payback percentage for the wagering game. The net payback that is considered significantly below an expected amount may be configurable. Further, statistical model 312 may be used to determine a threshold amount that is considered significantly below expectations.

Another "failure to win" category of bad beat events is the failure to win during a bonus round. The failure to win may be a failure to win anything at all during the bonus round, or it may be a win that is substantially below an expected amount or expected bonus multiplier for the bonus round. The threshold amount that is considered substantial may be determined based on statistical analysis of outcomes in statistical model 312. In some embodiments, a bad beat may be determined upon a failure to win a single bonus round. In alternative embodiments, a bad beat may not be determined until there have been multiple failures to win during bonus rounds.

A bad beat may be determined upon the detection of a "near miss" event. A near miss bad beat event is one in which the wagering game produces an outcome that can be perceived by the player as close to a win, but is not in fact a win or where the player wins a small amount, but was close to winning a larger amount. For example, in a slot machine, a near miss may occur when the symbol or symbols required for a payout (or a larger payout) are close to a payline. The number of symbols that are close, and the number of positions away from the payline may vary depending in different embodiments. For example, some embodiments may determine a bad beat has occurred if a single symbol required for a win is one position away from a payline. Alternative embodiments may determine a bad beat if two symbols are within one position of a payout. Still further embodiments may determine a bad beat if one symbol is within two positions of a win. The combination of reels, positions considered "close", and potential payout had the winning symbol actually been on the payline may vary depending on the number of reels, positions and paylines in the wagering game. Those of skill in the art having the benefit of the disclosure will appreciate that other combinations are possible and within the scope of the inventive subject matter.

Near miss bad beat events can be determined for other types of wagering games. For example, in a bingo style game, a near miss bad beat event may be determined if a player is one ball, or one number away from achieving a win when the game is over.

The determination of a bad beat event may be based on combinations of the above factors. For instance, a bad beat may be determined based on a combination of near misses and failures to win. As an example, a wagering game may be configured to determine a bad beat upon the occurrence of four near misses, ten winless spins, or a combination of two near misses and seven winless spins. Those of skill in the art having the benefit of the disclosure will appreciate that many other combinations of factors used in determining a bad beat are possible and within the scope of the inventive subject matter. Additionally, the factors contributing to a bad beat may be weighted such that some factors have more influence on whether a bad beat event is determined than other factors.

Statistical model 312 may be used to determine expected values for the number of winless streaks, or the number of times a near miss may occur. The expected frequency of the event may then be used to determine how often the event occurs before a bad beat is determined. Alternatively, the expected value could be used or configured in a business rule that is used to determine the occurrence of bad beat events. Additionally, the expected value may be used to determine the appropriate weightings for various factors based on the expected value of the factor.

At block 506, upon determining that a bad beat event has occurred, the system provides compensation to the player in the form of entering a second wagering game. In some embodiments, the second wagering game may be a bonus round of the wagering game being played. The player is compensated for the bad beat by entering the bonus round before such entry would have occurred in the ordinary course of the game.

In alternative embodiments, the second wagering game may be an alternative wagering game to the game currently being played. In some embodiments, the alternative wagering game can be a site-wide game in which multiple players at a wagering game establishment may be playing simultaneously. Further, the second alternative wagering game may be played simultaneously with wagering game currently being played. For example, a player may be playing a slots wagering game in which a bad beat event has occurred. The occurrence of the bad beat event causes the player to be automatically entered into a draw based game in which a winner may be randomly drawn from a pool of players currently entered into the draw based game. The player may continue playing the slots based game while the draw based game is being played. Further details of a draw based game used in some embodiments are provided below with respect to FIG. 7.

FIG. 6 is a flowchart illustrating a method 600 for compensating a player upon the occurrence of a bad beat event in accordance with alternative embodiments. The method begins at block 602 with the presentation of a wagering game. The wagering game may be any type of wagering game including mechanical or video slots or other video casino games, such as blackjack, keno, poker, blackjack, roulette, etc.

At block 604, a portion of the amount wagered is contributed to a bad beat progressive jackpot. The portion contributed to the progressive jackpot may be a relatively minor portion of the wager. The amount of the bad beat progressive jackpot continues to grow in accordance with the amount wagered on wagering games participating in the bad beat progressive. The bad beat progressive jackpot may be in addition to any other progressive jackpot in which the wagering game is participating.

At block 606, a bad beat event is detected at a wagering game. The detection of a bad beat event may be made in any of the ways described above with respect to block 504 (FIG. 5).

At block 608, upon detection of a bad beat event on a wagering game participating in the bad beat progressive, the progressive jackpot is paid out to the player experiencing the bad beat. The jackpot is reset to a default initial amount, and play of the wagering game may continue, with the bad beat progressive jackpot again growing based on the amounts wagered at wagering game machines participating in the bad beat progressive.

In some embodiments, not every bad beat event results in compensation to the player. In some embodiments, the "$n^{th}$" bad beat that occurs on wagering games participating in the bad beat progressive may cause a jackpot payout. As an example, a bad beat progressive may be configured such that a payout of the bad beat jackpot occurs every 2000 bad beats. A bad beat event that does result in some compensation to the player may be referred to as a compensable bad beat event.

In some embodiments, the bad beat hit frequency may be increased over time. The increase in hit frequency may also be accompanied by an increase in the payout or other compensation when a bad beat occurs. As an example, a system may be configured to award compensation at an initial hit frequency of 100 bad beats, in an amount of $10.00. That is, the $100^{th}$ player to experience a bad beat event receives compensation in the amount of $10.00. After the bad beat event is compensated, the hit frequency may be increases to 200 bad beat events, with an increase in the compensation amount to $20.00. Those of skill in the art having the benefit of the disclosure will appreciate that other hit frequencies and compensation amounts are possible and within the scope of the inventive subject matter.

Alternative methods of compensating for bad beat events may be used in addition to, or instead of, those discussed above in FIGS. 5 and 6. For example, in some embodiments, a player may be awarded one or more free spins upon the occurrence of a bad beat event. Alternatively, the player may be awarded a multiplier that multiplies the payout of the next win, or the payout of any amount won on the next spin or spins. Further, the player may be awarded "bonus money" that is an amount that is not legal tender, but can be spent on goods or services within a casino. Still further, the compensation for a bad beat may be a cash amount.

The compensation for a bad beat may be delivered electronically. For example, the entry into a second wagering game, the free spin or multiplier described above are examples of electronic delivery. Further, bonus money or other amounts may be electronically credited to a players account. In alternative embodiments, bad beat compensation may be personally delivered. For example, upon the occurrence of a bad beat event that is to be compensated, the system may automatically notify casino customer service staff, who then personally go to the wagering game machine location where the bad beat event occurred to deliver the bad beat compensation.

While FIGS. 5 and 6 have provided descriptions of various embodiments, it should be noted that other embodiments may incorporate features that modify or enhance the operation of the embodiments described above. For example, in some embodiments, the determination of a bad beat may vary depending on whether the player is a veteran player versus a new player. The player's status as a veteran or new player may be determined for example, by consulting a player tracking system to determine how often the player has played wagering games at a casino. The criteria for determining a bad beat for a new player may be such that a new player is compensated for a bad beat more often than a veteran player. This is in recognition of the fact that a new player may become more easily discouraged than a veteran player and leave the wagering game or casino. Alternatively, the system may compensate a veteran player more often than a new player in order to reward the loyalty of the veteran player and to encourage the new player to play often enough to earn a veteran status.

In some embodiments, not every bad beat is compensated. For example, a player may be compensated for a bad beat every $n^{th}$ bad beat. The determination of the $n^{th}$ bad beat may be on a single player basis, or it may be on a casino wide basis. To illustrate, a single player may be compensated every $10^{th}$ bad beat. Alternatively, a player may be compensated for a bad beat if the player has the $2000^{th}$ bad beat among all the bad beats experienced by players in the casino.

In some embodiments, the payout provided on a bad beat may be determined or adjusted based on the average of previous wagers. For example, in embodiments where a bonus amount is awarded to compensate for a bad beat, the size of the bonus amount may be based on the average of previous wagers. This is desirable, because a fixed bonus amount may overcompensate some players, and undercompensate others. To illustrate, a fixed bad beat compensation of $10 may overcompensate someone whose average bet is $0.10, and undercompensate a player whose average bet is $100.00.

Further, in some embodiments, determination of a bad beat may take into account play on multiple systems. For example, a player may log in to their account (e.g., insert a player tracking card) and start playing a first wagering game. Upon experiencing the start of a bad beat, the player may switch to a second wagering game and log in to the same account as used on the first wagering game. Upon detecting the continuation and completion of a bad beat on the second wagering game, bad beat compensation may be awarded. The first and second wagering games may be in the same casino or different casinos. Alternatively, the first wagering game may be in a casino and the second may be an online wagering game. In some embodiments, the system determines the bad beat compensation in accordance with a payout difference between the first and second wagering games. For example, if the first wagering game pays at 88% while the second wagering game pays at 92%, the system may determine a compensation level between 88% and 92%.

In some embodiments, the bad beat compensation may be different depending on whether the bad beat occurs in a casino based wagering game or an online wagering game. For example, the bad beat compensation may be designed to encourage the recipient to go to the land based casino equivalent of the online casino in order to redeem the bad beat compensation. As an example, the bad beat compensation may only be redeemable at a casino, or may be redeemed in a greater amount at a casino. This is desirable, as it can encourage a cyclical relationship where the land based casino can attract potential players to their establishments via online wagering games.

FIG. 7 is a flowchart illustrating a method 700 of operating a multi-player wagering game. The method begins at block 702 by receiving entries into the multi-player wagering game. The multi-player wagering game may be open to all entrants at a particular casino, and may be referred to as a site-wide wagering game. Entries may be purchased, provided during a play of a wagering game, provided as a reward or incentive (e.g., a reward for referring someone to a wagering game or casino), or provided as compensation for bad beat events as described above. In some embodiments, entry into the multi-player may be for a particular amount of time or a particular number of rounds of play. In alternative embodiments, a player may remain entered into the multi-player wagering game for as long as the player remains in the casino.

At block 704, a round of the multi-player wagering game is executed. In some embodiments, a draw type game is executed. For example, a round of play may comprise drawing a ball from a pool of balls.

At block 706, the system determines whether a win has occurred. In draw type games, the system determines whether the draw resulted in a win. To continue the ball example, assume that a pool of balls is the basis for the draw, where the balls have one of at least two colors. One of the colors is a winning color. A draw of a ball having the winning color results in a win, while a draw of a ball that is not a winning color results in the game continuing. The number of balls of the winning color will typically be substantially less than that of the non-winning colors. For example, a pool of 500 balls may have one ball that is the winning color and 499 balls that are not the winning color. At the end of a round, the drawn ball is returned to the pool of balls in some embodiments, such that the odds of a winning draw are the same from round to round.

At block 708, upon determining that a winning draw has occurred, all the current participants in the multi-player wagering game are provided a payout. In some embodiments, the payout for a winning draw is the same regardless of the number of players currently participating. That is, the players do not share a pool of available funds, rather the players are each awarded a predetermined amount. In alternative embodiments, a winning amount may be shared by all current entrants.

FIGS. 1-7 have described various operating environments and operations. The detailed description will continue with a description of an example wagering game machine.

Example Wagering Game Machine

Figure 8:
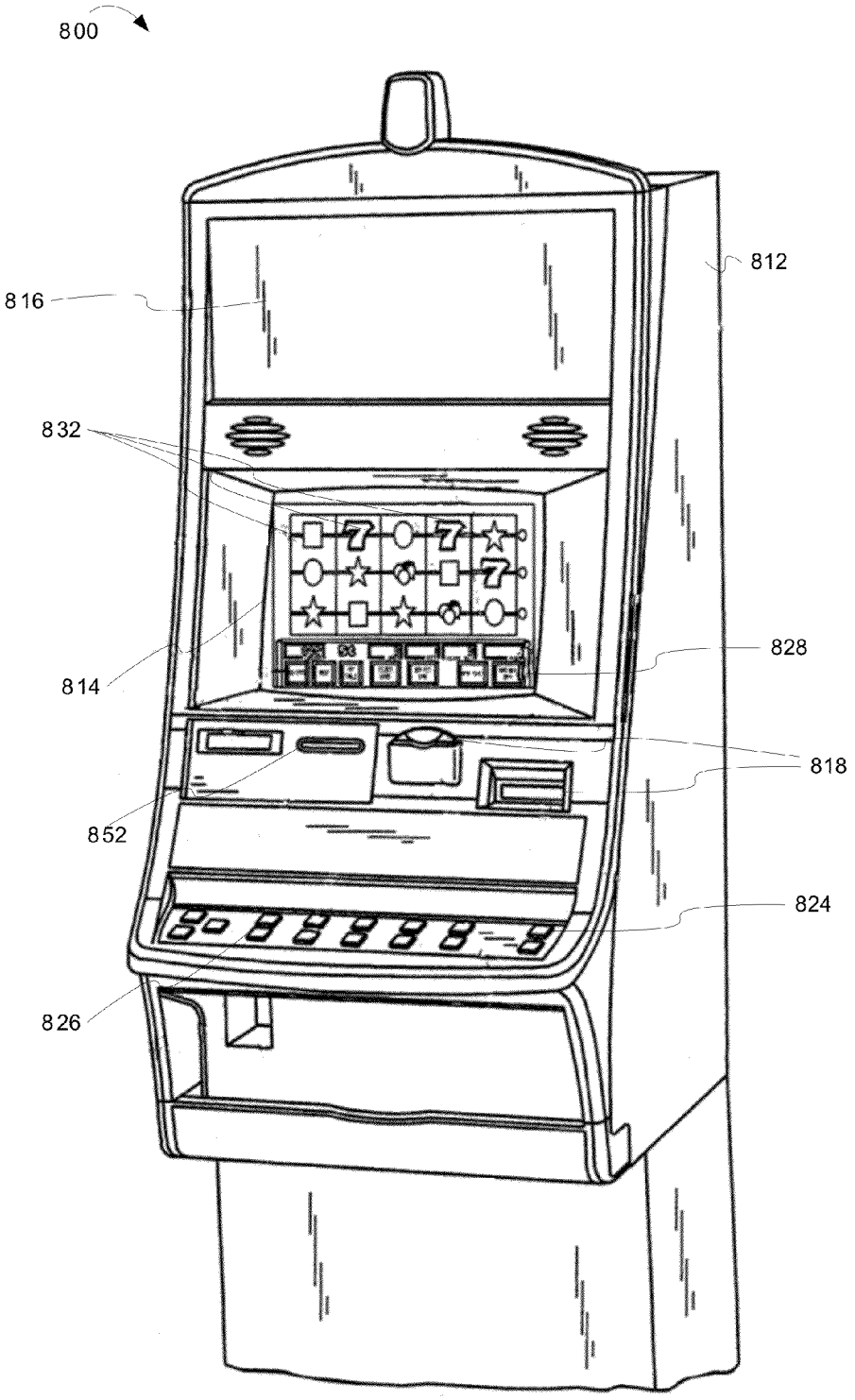
FIG. 8 is a perspective view of a wagering game machine, according to example embodiments of the invention.

FIG. 8 is a perspective view of a wagering game machine, according to example embodiments of the invention. Referring to FIG. 8, a wagering game machine 800 is used in gaming establishments, such as casinos. According to embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. The primary display 814 can also display information about a bonus wagering game and a progressive wagering game. The wagering game machine 800 also includes a secondary display 816 for displaying wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bartop model, mobile handheld model, or workstation console model.

A player begins playing a basic wagering game by making a wager via the value input device 818. The player can initiate play by using the player input device's buttons or touch screen 828. The basic game can include arranging a plurality of symbols along a payline 832, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

What is claimed is:

1. A method comprising:

presenting, via a display of a wagering game machine having one or more processors, a first wagering game upon which monetary value may be wagered;

determining, by the one or more processors, an occurrence of a bad beat event for the wagering game, wherein the occurrence of the bad beat event is determined, based at least in part, on a player status level maintained by a player tracking system, wherein the player status level comprises one of a plurality of player status levels, the player status level selected from the plurality of player status levels based, at least in part, on a wagering game history of a player, wherein each of the plurality of player status levels is associated with criteria for determining a bad beat event, and wherein the occurrence of the bad beat event is determined differently for each of the plurality of player status levels; and entering a second wagering game in response to determining the occurrence of the bad beat event.

2. The method of claim 1, wherein entering the second wagering game comprises entering a bonus round of the first wagering game.

3. The method of claim 1, and further comprising determining whether the bad beat event is a compensable bad beat event.

4. The method of claim 3, wherein determining the occurrence of a compensable bad beat event includes determining that a number of bad beat events has exceeded a threshold number.

5. The method of claim 1, wherein determining the occurrence of the bad beat event includes one or more of determining the occurrence of a failure to win bad beat event or determining the occurrence of a near miss bad beat event.

6. The method of claim 5, wherein the failure to win bad beat event comprises one or more of determining that a number of winless plays varies from an expected number of winless plays as determined from a statistical model, determining that entry to a bonus round has not occurred, determining that a multiplier value is less than a threshold value, determining a loss of monetary value during a wagering session has exceeded a threshold monetary value, or determining that a net payout percentage is below a threshold payout percentage.

7. The method of claim 5, wherein the first wagering game comprises a slots based wagering game and wherein the near miss bad beat event comprises an appearance of a symbol required for a win within a configurable or predetermined number of positions from a payline.

8. The method of claim 1, wherein the occurrence of the bad beat event is based, at least in part, on a statistical model developed for the first wagering game.

9. The method of claim 1, wherein determining an occurrence of a bad beat event for the wagering game includes applying a weighting to a plurality of factors contributing to the determination of the bad beat event.

10. A system comprising:

one or more processors configured to present, via a display of a wagering game machine, a first wagering game upon which monetary value may be wagered; and a bad beat compensation unit configured to:

determine an occurrence of a bad beat event for the wagering game, wherein the occurrence of the bad beat event is determined, based at least in part, on a player status level maintained by a player tracking system, wherein the player status level comprises one of a plurality of player status levels, the player status level selected from the plurality of player status levels based, at least in part, on a wagering game history of a player, wherein each of the plurality of player status levels includes criteria for determining a bad beat event, and wherein the occurrence of the bad beat event is determined differently for each of the plurality of player status levels, and enter a second wagering game in response to determining the occurrence of the bad beat event.

11. The system of claim 10, wherein the second wagering game comprises a bonus round of the first wagering game.

12. The system of claim 10, wherein the second wagering game comprises a site-wide wagering game, wherein a player is entered into the second wagering game for a duration determined, based at least in part, by the bad beat event, wherein a plurality of players are entered into the site-wide wagering game and wherein in response to a determination of a win event, all players currently entered into the site-wide wagering game receive a predetermined payout.

13. The system of claim 12, wherein the win event comprises a draw of a colored ball having a first color from a pool of colored balls, the colored balls having the first color or a second color.

14. The system of claim 10, wherein determining the occurrence of the bad beat event includes determining that either or both of a failure to win bad beat event or a near miss bad beat event has occurred.

15. The system of claim 14, wherein the failure to win bad beat event comprises one or more of a number of winless plays of the first wagering game, determining that entry to a bonus round has not occurred, determining that a multiplier value is less than a threshold value, determining a loss during a wagering session has exceeded a threshold value, or determining that a net payout percentage is below a threshold payout percentage.

16. The system of claim 14, wherein the first wagering game comprises a slots based wagering game and wherein the near miss bad beat event comprises an appearance of a symbol required for a win within a configurable or predetermined number of positions from a payline.

17. A non-transitory machine-readable medium having stored thereon instructions for causing one or more processors to perform operations comprising:

presenting, via a display of a wagering game machine having one or more processors, a first wagering game upon which monetary value may be wagered;

determining an occurrence of a bad beat event for the wagering game, wherein the occurrence of the bad beat event is determined, based at least in part, on a player status level maintained by a player tracking system, wherein the player status level comprises one of a plurality of player status levels, the player status level selected from the plurality of player status levels based, at least in part, on a wagering game history of a player, wherein each of the plurality of player status levels includes criteria for determining a bad beat event, and wherein the occurrence of the bad beat event is determined differently for each of the plurality of player status levels; and entering a second wagering game in response to determining the occurrence of the bad beat event.

18. The non-transitory machine-readable medium of claim 17, wherein entering the second wagering game comprises entering a bonus round of the first wagering game.

19. The non-transitory machine-readable medium of claim 17, wherein the operations further comprise determining whether the bad beat event is a compensable bad beat event.

20. The non-transitory machine-readable medium of claim 19, wherein determining the occurrence of a compensable bad beat event includes determining that a number of bad beat events has exceeded a threshold number.

21. The non-transitory machine-readable medium of claim 17, wherein determining the occurrence of the bad beat event includes determining that either or both of a failure to win bad beat event or a near miss bad beat event has occurred.

22. The non-transitory machine-readable medium of claim 21, wherein the failure to win bad beat event comprises one or more of a number of winless plays of the first wagering game, determining that entry to a bonus round has not occurred, a multiplier value that is less than a threshold value, a loss during a wagering session that has exceeded a threshold value, or a net payout percentage that is below a threshold payout percentage.

23. The non-transitory machine-readable medium of claim 21, wherein the first wagering game comprises a slots based wagering game and wherein the near miss bad beat event comprises an appearance of a symbol required for a win within a configurable or predetermined number of positions from a payline.

24. The non-transitory machine-readable medium of claim 17, wherein the occurrence of the bad beat event is determined a statistical model developed for the first wagering game.

25. The non-transitory machine-readable medium of claim 24, wherein the statistical model is developed utilizing a plurality of simulated executions of the wagering game.

26. The non-transitory machine-readable medium of claim 17, wherein determining an occurrence of a bad beat event for the wagering game includes applying a weighting to a plurality of factors contributing to the determination of the bad beat event.

27. The non-transitory machine-readable medium of claim 17, wherein determining an occurrence of a bad beat event for the wagering game is based, at least in part, on outcomes from a plurality of wagering games played by a user on a plurality of wagering game machines.

* * * * *